United States Patent [19]

Turnbull

[11] Patent Number: 4,907,387

[45] Date of Patent: Mar. 13, 1990

[54] PATIO DECK SHEATH

[76] Inventor: James Turnbull, 761-11th Avenue, Fernie, British Columbia, Canada, V0B 1M0

[21] Appl. No.: 210,038

[22] Filed: Jun. 22, 1988

[51] Int. Cl.[4] ..... F16S 3/02

[52] U.S. Cl. ..... 52/177; 52/181

[58] Field of Search ..... 52/177, 179, 180, 181, 52/660, 662

[56] References Cited

U.S. PATENT DOCUMENTS

| | | | |
|---|---|---|---|
| 1,091,214 | 3/1914 | Gruber | 52/177 |
| 1,363,413 | 12/1928 | Hester . | |
| 1,687,600 | 10/1928 | Welcome | 52/181 |
| 2,278,554 | 4/1942 | Morton | 52/180 |
| 2,787,036 | 4/1957 | Mermer | 52/179 |
| 2,895,389 | 7/1959 | Nagin | 52/180 |
| 3,156,168 | 11/1964 | Nagin et al. | 52/177 |
| 3,313,071 | 4/1967 | Johnston et al. | 52/177 |
| 3,420,015 | 1/1969 | Costanzo, Jr. | 52/180 |
| 3,640,035 | 2/1972 | Butterfield | 52/177 |
| 3,765,136 | 10/1973 | Mudd | 52/180 |
| 4,194,330 | 3/1980 | Smith | 52/177 |
| 4,258,662 | 3/1981 | Schafer . | |
| 4,266,381 | 5/1981 | Deller | 52/177 |

FOREIGN PATENT DOCUMENTS

| | | | |
|---|---|---|---|
| 1462370 | 12/1966 | France | 52/179 |
| 2549113 | 1/1985 | France | 52/177 |
| 170238 | 10/1921 | United Kingdom | 52/177 |
| 195146 | 3/1923 | United Kingdom | 52/177 |
| 2116596 | 9/1983 | United Kingdom | 52/177 |
| 2143556 | 2/1985 | United Kingdom | 52/177 |

*Primary Examiner*—Michael Safavi

*Attorney, Agent, or Firm*—Bull, Housser & Tupper

[57] ABSTRACT

A combination of a deck having a plurality of spaced apart wooden deck members on the surface thereof wherein each deck member has a top, sides and a bottom and an apparatus for covering the deck members. The apparatus comprises a plurality of channel shaped members each of which has a flat top portion for covering the entire top of one deck member. The flat top portion has a rough top surface to inhibit persons from slipping on the deck. The channel shaped member also has first and second side portions which extend generally perpendicular to the top portion. The first and second side portions are generally parallel to each other and are spaced apart to receive one deck member therebetween. The side portions of the channel shaped member extend over the sides of the deck member from the top to the bottom thereof.

5 Claims, 2 Drawing Sheets

PATIO DECK SHEATH

FIELD OF THE INVENTION

The invention relates to an apparatus for covering deck members of a deck.

BACKGROUND OF THE INVENTION

An outdoor deck is known to have deck members, such as two-by-fours, which form the surface thereof. The deck members are typically painted or stained for protection from the weather. In some cases, grit or silicone globules are added to the paint to provide an anti-slip surface. Over years of wear, the paint or stain is scuffed by persons walking on the deck, is baked by the sun and is drenched with water from rain and snow. Paint naturally begins to crack and peel, leaving bare spots of wood which are susceptible to rot due to the weather. Constant walking on the deck loosens nails holding the deck members down, which further cracks the paint, thereby allowing moisture to penetrate the wood through the nail holes. The result is that the deck members require periodic painting if the wood is to be prevented from rotting. Furthermore, persons walking on the deck in bare feet may get wood splinters in their feet or cuts from protruding nails.

Moulding strips made of extruded plastic are available for covering the edges of cupboard shelves, etc. Such moulding strips have a smooth, flat or rounded surface and two spaced-apart short sides extending at right angles to the flat surface for sliding onto the edge of a shelf. Moulding strips are not readily adaptable to be used on deck members of a deck due to their size and the absence of a frictional surface for preventing persons from sliding on the deck. Nor has such a combination been suggested. The edges of the moulding are rather short and would not offer sufficient resistance to rocking and creepage of the device when the deck member is walked upon. Furthermore, the pliability and guage of the moulding material for shelves would soon lead to cracks and subsequent chipping is used on a deck where exposure to rain, snow, sunlight and the weight of persons walking on the deck is unavoidable.

The present invention eliminates the need for painting of the deck members and eliminates the possibility of wood splinters and protruding nails for bare feet, yet provides a deck covering having an anti-slip surface.

The invention relates to a combination of a deck having a plurality of spaced apart wooden deck members forming the surface thereof, each said deck member having a top, sides and a bottom and an apparatus for covering said deck members. The apparatus comprises a plurality of channel shaped members, each said channel shaped member having a flat top portion covering the entire top of one said deck member. The top portion has a rough top surface. Each channel shaped member also has first and second side portions extending generally perpendicular to said top portion. The first and second side portions are generally parallel to each other and are spaced apart to receive one said deck member therebetween. The side portions extend over the sides of said one deck member from the top to the bottom thereof.

DESCRIPTION OF THE PREFERRED EMBODIMENT

Figure 1:
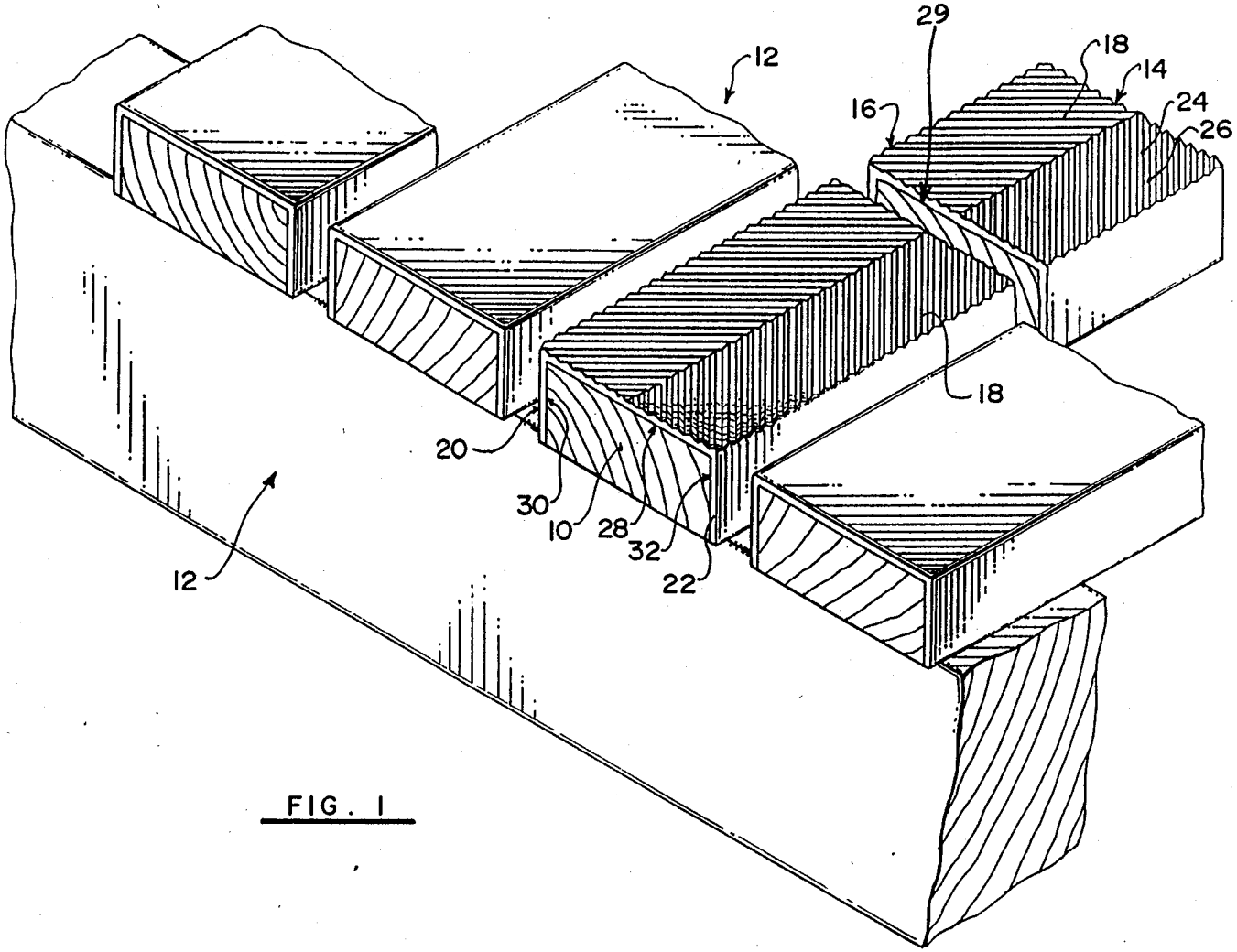
FIG. 1 is a simplified, fragmented isometric view of a deck having a plurality of channel-shaped members according to an embodiment of the invention installed on the deck members.

Referring to FIG. 1, an apparatus for covering a deck member 10 of a deck 12, is shown generally at 14. In the illustrated deck, there is a plurality of deck members 10 which are 2×4 lumber, each deck member having a surface 28 forming a portion of a surface 29 of said deck 12. The apparatus includes a channel-shaped member 16 having a flat top surface 18 and first and second sides 20 and 22 extending generally perpendicular to the flat surface. In this example, the member 16 is of weather durable plastic and is formed by extrusion.

In the preferred embodiment, the flat surface 18 includes a plurality of ridges 24 alternating with grooves 26, formed in the top surface 18 of the member 16, thereby providing a rough texture. The grooves are generally one-sixteenth of an inch deep and are formed in a herringbone pattern, to provide an anti-slip surface. The herringbone pattern provides traction for persons walking in any direction on the surface. The grooves and ridges may be formed on the top surface after the member 16 is extruded.

The first and second sides 20 and 22 extend generally parallel to each other and extend generally perpendicular to the plane of the flat surface 18. The sides are spaced-apart and slightly angled inwardly, to receive and grip the deck member 10 therebetween.

The channel member 16 fits over top surface 28 and side surfaces 30 and 32 of the deck member 10, to embrace it securely. The sides 20 and 22 of the channel member 16 grip the side surfaces of the deck member, thereby preventing sideways movement of the channel member with respect to the deck member. The deck member is thus protected from the weather and is also protected from wear, due to persons walking on the deck.

Figure 2:
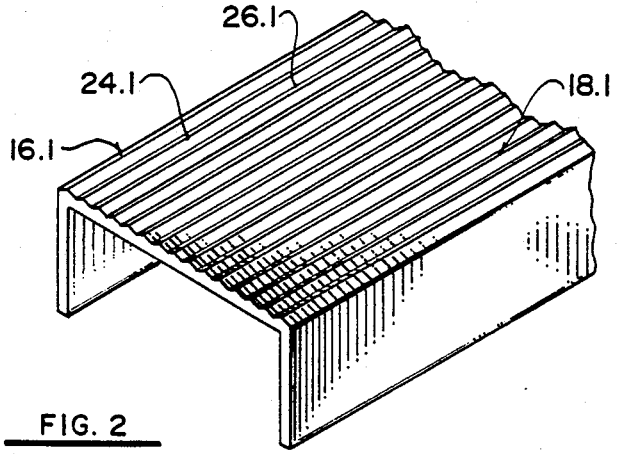
FIG. 2 is a simplified fragmented isometric view of a channel-shaped member according to an alternative embodiment of the invention and having parallel ridges and grooves on the top surface thereof.

In an alternative embodiment, shown in FIG. 2, channel member 16.1 has ridges 24.1 and grooves 26.1 on the top surface 18.1. The ridges and grooves are parallel to each other and extend the length of the member 16.1. Such a groove pattern is suitable for stairs, where the channel member would be installed such that persons would normally walk perpendicular to the grooves.

In another alternative embodiment (not shown) the roughened surface includes a plurality of dimples formed in the top surface of the channel member. The dimples provide an anti-slip surface having a different appearance from that of the above-mentioned groove patterns. The dimples also offer a more comfortable anti-skip surface to persons walking in bare feet, than provided by the groove patterns above.

Figure 3:
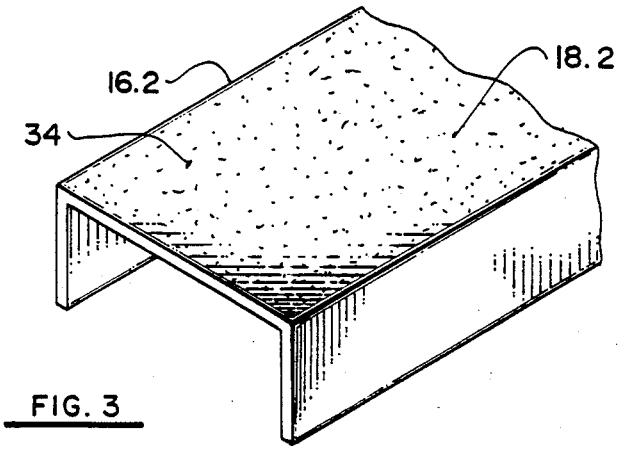
FIG. 3 is a simplified fragmented isometric view of a channel-shaped member according to a further alternative embodiment of the invention and having a dimpled top surface.

In yet another alternative embodiment, illustrated by FIG. 3, the roughened surface includes particles of grit or sand 34 adhering to the flat top surface of the channel member 16.2. The grit or sand provides an anti-slip surface having yet another different appearance from that of the above-mentioned patterns. The grit or sand surface offers a comfortable anti-slip surface which provides good traction to persons in bare feet, even when the surface is drenched with water. Such a surface is desirable on decks surrounding a swimming pool.

Figure 4:
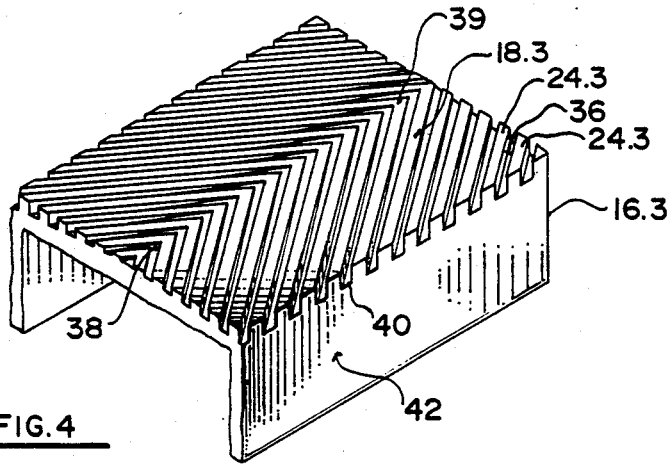
FIG. 4 is a simplified fragmented isometric view of a channel-shaped member according to a further alternative embodiment of the invention and having a plurality of sloping grooves in the top surface thereof.

In yet another alternative embodiment illustrated in FIG. 4, the top surface 18.3 of the channel member 16.3 includes of plurality of grooves 36 formed between ridges 24.3 which have co-planar tops. The grooves have a shallow end 38 near the centre 39 of the top surface. The grooves slope to a deep end 40 near the sides 42. The grooves therefore slipe downwardly towards the sides to help to keep the channel member clean by inducing water runoff which carries away dirt particles. The grooves also provide good traction to persons walking on the deck.

It is believed that, when manufacturing channel members by the extrusion process, the maximum thickness of the top surface and of the sides of the member may be about ⅛ of an inch. Thicknesses greater than ⅛ of an inch may give rise to imperfections such as bubbling in the surface. Channel members greater than ⅛" thick are, however, within the scope of the invention as set forth in the accompanying claims.

OPERATION

The channel member 16 in the preferred embodiment is fastened to the deck member 10 by first applying a bonding material, such as contact cement, to the underside of the channel member and to the top surface 28 of the deck member. The channel member is then fitted over the deck member and pressed or rolled to ensure good contact with the bonding material. Alternatively, in other embodiments other means for fastening could be employed such as an adhesive strip on the channel member with a peel off covering.

Changes and modifications in the specifically described embodiments can be carried out without departing from the scope of the invention, which is intended to be limited only by the scope of the appended claims.

What is claimed is:

1. In combination:

a deck having a plurality of spaced apart wooden deck members forming the surface of said deck, each said deck member having a top, sides and a bottom; and an apparatus for covering said deck members, the apparatus comprising a plurality of channel shaped members, each said channel-shaped member having a flat top portion covering the entire top of one said deck member, the top portion having a rough top surface, said each channel-shaped member having first and second side portions extending generally perpendicular to said top portion, the first and second side portions being generally parallel to each other and being spaced apart and receiving said one deck member therebetween, said side portions extending over the sides of said one deck member from the top to the bottom thereof.

2. A combination as claimed in claim 1, wherein the top surface of said each channel-shaped member includes a plurality of ridges alternating with grooves.

3. A combination as claimed in claim 1, further including grit adhering to the top surface of each said channel-shaped member.

4. A combination as claimed in claim 2, wherein said ridges and grooves are in a herringbone pattern.

5. A combination as claimed in claim 2, wherein the grooves have bottoms which slope downwardly towards the sides of the apparatus, the ridges having coplanar tops.

* * * * *